US010526671B2

(12) United States Patent
Hata et al.

(10) Patent No.: US 10,526,671 B2
(45) Date of Patent: Jan. 7, 2020

(54) COLD-ROLLED STEEL SHEET AND PROCESS FOR MANUFACTURING SAME

(71) Applicant: NIPPON STEEL & SUMITOMO METAL CORPORATION, Tokyo (JP)

(72) Inventors: Kengo Hata, Tokyo (JP); Toshiro Tomida, Tokyo (JP); Norio Imai, Tokyo (JP); Jun Haga, Tokyo (JP); Takuya Nishio, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 918 days.

(21) Appl. No.: 14/379,853

(22) PCT Filed: Feb. 13, 2013

(86) PCT No.: PCT/JP2013/053312
§ 371 (c)(1),
(2) Date: Aug. 20, 2014

(87) PCT Pub. No.: WO2013/125399
PCT Pub. Date: Aug. 29, 2013

(65) Prior Publication Data

US 2015/0027593 A1 Jan. 29, 2015

(30) Foreign Application Priority Data

Feb. 22, 2012 (JP) ..... 2012-036474

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/18*** | (2006.01) |
| ***C22C 38/26*** | (2006.01) |
| ***C22C 38/38*** | (2006.01) |

(52) U.S. Cl.

CPC ..... *C21D 8/0236* (2013.01); *C21D 8/0247* (2013.01); *C21D 8/0284* (2013.01); *C22C 38/00* (2013.01); *C22C 38/002* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C22C 38/26* (2013.01); *C22C 38/38* (2013.01); *C21D 2211/002* (2013.01); *C21D 2211/005* (2013.01); *C21D 2211/008* (2013.01)

(58) Field of Classification Search

CPC ..... C22C 38/38; C22C 38/26; C22C 38/14; C22C 38/12; C22C 38/00; C22C 38/002; C22C 38/005; C22C 38/02; C22C 38/04; C22C 38/06; C22C 38/18; C21D 8/0236; C21D 8/0247; C21D 8/0284; C21D 2211/001; C21D 2211/002; C21D 2211/005; C21D 2211/008

See application file for complete search history.

(56) References Cited

U.S. PATENT DOCUMENTS

| | | | | |
|---|---|---|---|---|
| 2008/0202639 | A1 | 8/2008 | Tomida et al. | |
| 2011/0139315 | A1* | 6/2011 | Nakagaito et al. | 148/533 |

FOREIGN PATENT DOCUMENTS

| | | | | |
|---|---|---|---|---|
| CN | 101748347 | | 6/2010 | |
| EP | 2 258 886 | | 12/2010 | |
| JP | 2004211140 | A * | 7/2004 | C22C 38/00 |
| JP | 2006-002186 | | 1/2006 | |
| JP | 2007-321236 | | 12/2007 | |
| JP | 2008-291304 | | 12/2008 | |
| JP | 2009-203548 | | 9/2009 | |
| JP | 2010-126770 | | 6/2010 | |
| JP | 2010-156032 | | 7/2010 | |
| JP | 2011-149066 | | 8/2011 | |
| JP | 2011-214081 | | 10/2011 | |
| WO | 2007/015541 | | 2/2007 | |

* cited by examiner

*Primary Examiner* — Alexandra M Moore
(74) *Attorney, Agent, or Firm* — Clark & Brody

(57) ABSTRACT

A high-strength cold-rolled steel sheet having excellent ductility and stretch flangeability includes: a chemical composition consisting, in mass %, C: 0.06 to 0.3, Si: 0.6 to 2.5%, Mn: 0.6 to 3.5%, P: at most 0.1%, S: at most 0.05%, Ti: 0 to 0.08%, Nb: 0 to 0.04%, total of Ti and Nb: 0 to 0.10%, sol.Al: 0 to 2.0%, Cr: 0 to 1%, Mo: 0 to 0.3%, V: 0 to 0.3%, B: 0 to 0.005%, Ca: 0 to 0.003%, REM: 0 to 0.003% and the remainder of Fe and impurities; a microstructure having a main phase including at least 40 area % in total of martensite and/or bainite; and a texture in which proportion of an average X-ray intensity in an {100}<011> to {211}<011> orientations relative to an average X-ray intensity of a random structure not having a texture is less than 6.

20 Claims, No Drawings

COLD-ROLLED STEEL SHEET AND PROCESS FOR MANUFACTURING SAME

TECHNICAL FIELD

The present invention relates to a cold-rolled steel sheet and a process for manufacturing the same. More particularly, the present invention relates to a cold-rolled steel sheet having excellent workability in addition to a high strength, and a process for manufacturing the same with excellent stability.

BACKGROUND ART

Regarding techniques for improving the mechanical properties of cold-rolled steel sheets, following Patent Document 1 indicated discloses a high-strength steel sheet having bainitic ferrite as a main phase, and containing at least 3% lath type austenite and 1% to (lath type retained austenite area occupancy ratio×½) block-type austenite, the steel sheet being described as having excellent ductility and stretch flangeability. However, the block-type austenite in this steel sheet has grain diameters of around 2.2 μm to 20 μm and thus is coarse, and therefore can be considered as adversely affecting the formability of the steel sheet.

Patent Document 2 discloses a method for performing cold rolling using a hot-rolled steel sheet manufactured by hot rolling and then starting cooling in a short period of time after the hot rolling. For example, Patent Document 2 discloses that a hot-rolled steel sheet having a fine structure containing ferrite having a small average grain diameter as a main phase is manufactured by performing cooling to at most 720° C. at a cooling rate of at least 400° C./sec within 0.4 seconds after hot rolling and the hot-rolled steel sheet is subjected to usual cold rolling and annealing to manufacture a cold-rolled steel sheet. Hereinafter, the above hot-rolled steel sheet production process may also be referred to as immediate cooling method.

PRIOR ART DOCUMENTS

Patent Document

Patent Document 1: JP 2007-321236 A
Patent Document 2: WO2007/015541 A

SUMMARY OF INVENTION

According to the method disclosed in Patent Document 2, structure may be refined without inclusion of precipitating elements and thus a cold-rolled steel sheet having excellent ductility can be manufactured. The manufactured cold-rolled steel sheet also has a fine structure even after cold rolling and recrystallization because a hot-rolled steel sheet, which is a starting material of the cold-rolled steel sheet, has a fine structure. Thus, the produced austenite also becomes fine and as a result, a cold-rolled steel sheet having a fine structure can be obtained. However, since the usual annealing is performed after cold rolling, recrystallization occurs in a heating process during the annealing, and after completion of the recrystallization, austenite transformation occurs as grain boundaries in the structure after the recrystallization function as nucleus forming sites. In other words, after most preferred nucleus forming sites for austenite transformation such as high angle grain boundaries, fine carbide grains and a low temperature transformation phase existing in the hot-rolled steel sheet have disappeared during the heating in the annealing, austenite transformation occurs. Accordingly, although a cold-rolled steel sheet obtained by the method disclosed in Patent Document 2 has a fine structure, refining austenite grain in an annealing process is restrictedly premised on the structure after recrystallization, and thus, the fine structure cannot be easily obtained after cold rolling and annealing even if the hot-rolled steel sheet has the fine structure. In particular, when annealing is carried out for a single-phase austenite region, it is difficult to utilize the fine structure of the hot-rolled steel sheet in order to refine the structure after cold rolling and annealing.

An object of the present invention is to provide a cold-rolled steel sheet having excellent ductility and stretch flangeability in addition to a high strength by enabling to effectively refine a structure after cold rolling and annealing even if a large amount of precipitating elements such as Ti and Nb, which are known as being effective for structure refinement is not added, and a process for manufacturing the same.

The present inventors employed a composite-structure having a main phase of either or both of martensite and bainite, which are low temperature transformation phases and focused on suppression of growth of a particular texture, in order to obtain a structure for providing excellent ductility and stretch flangeability in addition to high strength.

Furthermore, generally, a decrease in stretch flangeability (hole expanding formability) for a structure containing a soft phase, such as ferrite, and retained austenite intermixed therein is concerned, and thus, investigation is performed based on the material quality design concept that such decrease in stretch flangeability is minimized by refining ferrite and/or controlling retained austenite form.

In order to obtain such structure, the present inventors conceived of the new concept of promoting austenitic transformation before completion of recrystallization in an annealing process after cold rolling, as opposed to the conventional annealing method in which austenitic transformation is promoted after completion of recrystallization, and performing annealing in an adequate high temperature range for suppression of growth of a particular texture, and conducted test.

As a result, the present inventors obtained the following new knowledge.

1) In the conventional annealing method for promoting austenitic transformation after completion of recrystallization, since austenitic transformation occurs with grain boundaries in the structure after the recrystallization as nucleus forming sites, refining austenite grains (prior austenite grains after annealing; hereinafter also referred to as "prior austenite grains") in the annealing process receives a restriction that the refining is premised on performing austenitic transformation from the structure after recrystallization.

On the other hand, in the annealing method for promoting austenitic transformation by rapid heating to a temperature range in which austenite is produced before completion of recrystallization, since austenitic transformation occurs from high angle grain boundaries, fine carbide grains and low-temperature transformation phases, which are preferred nucleus forming sites for austenitic transformation, in the hot-rolled steel sheet, the austenite grains are dramatically refined during the annealing process. As a result, the structure of the cold-rolled steel sheet after the annealing is effectively refined.

2) In such annealing method for promoting austenitic transformation by rapid heating to a temperature range in which austenite is produced before completion of recrystallization, since a worked ferrite structure intends to retain, a particular texture grows, as a result, g and workability of the steel sheet intend to decrease.

On the other hand, if annealing is carried out in an adequate high temperature range, recrystallization and austenitizing of the worked ferrite structure is promoted, whereby while the fine structure is maintained, growth of the particular texture is suppressed in connection with the structure refinement to enable ensuring of excellent ductility and stretch flangeability.

3) Although containing ferrite having an excellent ductility enables improvement in ductility of the cold-rolled steel sheet, in general, concern about a structure containing a soft phase such as ferrite is a decrease in stretch flangeability because when the steel sheet is worked, clacking easily occurs in an interface between the soft phase and a hard phase.

However, as stated above, by refining the structure of the cold-rolled steel sheet after annealing, the ferrite is also refined. Consequently, the formation and development of fine cracks at the time of working of a steel sheet are effectively suppressed, whereby the decrease in stretch flangeability is prevented. Thus, containing fine ferrite enables ductility improvement and ensuring of excellent stretch flangeability.

4) Ductility of the cold-rolled steel sheet is further improved by containing retained austenite which exhibits a ductility improvement effect due to strain induced transformation. However, it is concerned that generally, a structure containing retained austenite results in decreasing stretch flangeability because retained austenite is transformed to hard martensite due to the strain induced transformation, which may cause cracking when the steel sheet is worked.

In this regard, in the case of a steel sheet obtained by the annealing method for promoting austenitic transformation before completion of recrystallization in an annealing process after cold rolling, a fraction of lump-like retained austenite having an aspect ratio of less than 5 in all the retained austenite increases. This is because by refining prior-austenite grain, a retained austenite existing on the prior-austenite grain boundaries, the packet boundaries and the block boundaries increases and a retained austenite produced among laths of bainite and/or martensite decreases. Such lump-like retained austenite has higher stability against work strain than the retained austenite produced among laths of bainite and/or martensite and thus increases the work hardening coefficient in high strain regions. Thus, the ductility of the steel sheet can effectively be improved.

Then, as described above, refining retained austenite and increasing fraction of lump-like retained austenite having an aspect ratio of less than 5 resulting from effective refinement of the structure of a cold-rolled steel sheet after annealing prevents a decrease in stretch flangeability of the cold-rolled steel sheet. Thus, by containing fine and low-aspect ratio retained austenite, ductility can be improved and excellent stretch flangeability of the cold-rolled steel sheet can be maintained.

5) As stated above, in the annealing method in which austenitic transformation is promoted before completion of recrystallization in an annealing step after cold rolling, prior-austenite grains are effectively refined because nuclei of austenitic transformation forms from the high angle grain boundaries, fine carbide grains, and the low-temperature transformation phases, which are preferred nucleus forming sites of austenitic transformation, in the hot-rolled steel sheet. Thus, as a process for manufacturing a hot-rolled steel sheet, the production method described in Patent Document 2, which provides a hot-rolled steel sheet containing preferred nucleus forming sites of austenitic transformation in high density, is preferable. Employment of the above annealing method for a hot-rolled steel sheet obtained by the production method described in Patent Document 2 provides further refining austenite grains in the annealing process and further refining the structure of the cold-rolled steel sheet after the annealing.

The present inventors found that as a result of the above structure refinement, ductility of the cold-rolled steel sheet and the balance between the ductility and the stretch flangeability is significantly improved.

An aspect of the present invention provides a cold-rolled steel sheet characterized by having: a chemical composition comprising, in mass % of C: 0.06 to 0.3%, Si: 0.6 to 2.5%, Mn: 0.6 to 3.5%, P: at most 0.1%, S: at most 0.05%, Ti: 0 to 0.08%, Nb: 0 to 0.04%, a total of Ti and Nb: 0 to 0.10%, sol.Al: 0 to 2.0%, Cr: 0 to 1%, Mo: 0 to 0.3%, V: 0 to 0.3%, B: 0 to 0.005%, Ca: 0 to 0.003%, REM: 0 to 0.003%, and a remainder of Fe and impurities; a microstructure having a main phase of either or both of martensite and bainite which comprising at least 40 area % in total; and a texture in which ratio of the average X-ray intensity for the {100}<011> to {211}<011> orientations relative to the average X-ray intensity of a random structure which does not have a texture at a depth of ½ of the sheet thickness is less than 6.

A main phase in a microstructure means a phase having a largest area fraction, and a second phase means to any of phases other than the main phase.

It is preferable that the cold-rolled steel sheet according to the present invention further provides one or more of the following features (1) to (8).

(1) The microstructure has the second phase of ferrite which comprises at least 3% and satisfies Equation (1):

$$d_F \leq 4.0 \quad (1).$$

where $d_F$ is an average grain diameter (unit: μm) of ferrite defined by high angle grain boundaries having a tilt angle of at least 15°.

(2) The microstructure has the second phase of retained austenite which comprises at least 3 area %, and satisfies Equations (2) and (3):

$$d_{As} \leq 1.5 \quad (2); \text{ and}$$

$$r_{As} \geq 50 \quad (3),$$

where $d_{As}$ is an average grain diameter (unit: μm) of retained austenite having an aspect ratio of less than 5 and $r_{As}$ is an area fraction (%) of the retained austenite having an aspect ratio of less than 5 relative to all retained austenite.

(3) The chemical composition contains, in mass %, one or two selected from Ti: 0.005 to 0.08% and Nb: 0.003 to 0.04%.

(4) The chemical composition contains, in mass %, sol.Al: 0.1 to 2.0%.

(5) The chemical composition contains one or more selected from, in mass %, of Cr: 0.03 to 1%, Mo: 0.01 to 0.3% and V: 0.01 to 0.3%.

(6) The chemical composition contains, in mass %, B: 0.0003 to 0.005%.

(7) The chemical composition contains one or two selected from, in mass %, 0.0005 to 0.003% and REM: 0.0005 to 0.003%.

(8) The cold-rolled steel sheet has a plating layer on the surface.

Another aspect of the present invention provides process for manufacturing a cold-rolled steel sheet characterized by comprising the following steps (A) and (B):

(A) a cold rolling step in which a hot-rolled steel sheet having the above chemical composition is subjected to cold rolling to obtain a cold-rolled steel sheet; and (B) an annealing step in which the cold-rolled steel sheet obtained in Step (A) is subjected to heat treatment under conditions that the cold-rolled steel sheet is heated at an average heating rate condition of at least 15° C./sec so that the proportion of unrecrystallization relative to a region not transformed to austenite when the temperature ($Ac_1$ point+10° C.) is reached is at least 30 area %, and is then held in a temperature range of at least ($0.3\times Ac_1$ point+$0.7\times Ac_3$ point) and at most ($Ac_3$ point+100° C.) for at least 30 seconds, and the steel sheet is then cooled at an average cooling rate of at least 10° C./sec for a temperature range of at most 650° C. and at least 500° C.

It is preferable that the process for manufacturing the cold-rolled steel sheet according to the present invention provides one or more of following features (9) to (13).

(9) The hot-rolled steel sheet is obtained by coiling at a temperature of at most 300° C. after completion of hot rolling and subsequent heat treatment in a temperature range of 500° C. to 700° C.

(10) The hot-rolled steel sheet is a steel sheet with average grain diameter of a BCC phase defined by high angle grain boundaries having a tilt angle of at least 15° is at most 6 μm, the steel sheet being obtained by a hot rolling step of cooling at a cooling rate (Crate) satisfying Equation (4) below for a temperature range from a temperature at the completion of rolling to (temperature at the completion of rolling −100° C.) after completion of hot rolling in which hot rolling is completed at at least an $Ar_3$ point.

$$IC(T) = 0.1 - 3\times10^{-3}\cdot T + 4\times10^{-5}\cdot T^2 - 5\times10^{-7}\cdot T^3 + 5\times10^{-9}\cdot T^4 - 7\times10^{-11}\cdot T^5 \int_0^{-100} \frac{-dT}{\mathrm{Crate}(T)\cdot IC(T)} < 4 \quad (4)$$

In the above equation, Crate (T) is a cooling rate (° C./s) (positive value),

T is a relative temperature with the temperature at the completion of rolling as zero (T=(temperature of steel sheet during cooling−temperature at completion of rolling) ° C., negative value), and if a temperature at which Crate is zero exists, a value obtained by dividing a holding time (ΔT) at the temperature by IC (T) is added as an integral for the section.

(11) The cooling for the temperature range in above (10) includes starting cooling at a cooling rate of at least 400° C./sec and cooling at the cooling rate for a temperature range of at least 30° C.

(12) The cooling for the temperature range in above (10) includes starting water cooling at a cooling rate of at least 400° C./sec and cooling at the cooling rate for a temperature range of at least 30° C. and at most 80° C., and then stopping a water cooling for 0.2 to 1.5 seconds to measure a shape of the sheet during stopping water cooling, and subsequently cooling at a rate of at least 50° C./sec.

(13) The process for manufacturing the cold-rolled steel sheet further has the step of plating the cold-rolled steel sheet after the (B) step.

The present invention provides effectively refining a structure after cold rolling and annealing without addition of a large amount of elements which precipitate such as Ti and Nb, and thus provides a high-strength cold-rolled steel sheet having excellent ductility and stretch flangeability and a process for manufacturing the same. Since the structure refinement mechanism which is different from that of the conventional method is adopted in the present invention, a fine structure can be obtained even if a holding time for annealing is made long enough to obtain a stable material.

DESCRIPTION OF EMBODIMENT

The cold-rolled steel sheet according to the present invention and the process for manufacturing the same will be described below. In the below description, each of "%"s in chemical compositions is "mass %." Also, each of average grain diameters in the present invention means an average Heywood diameter value obtained according to Equation (4), which will be described later, using SEM-EBSD.

1. Cold-Rolled Steel Sheet 1-1: Chemical Composition

[C: 0.06 to 0.3%]

C has the effect of increasing the strength of steel. Also when C is concentrated in austenite, C has the effect of obtaining the stable austenite, increasing the area fraction of retained austenite in the cold-rolled steel sheet and thereby increasing the ductility. Furthermore, in the hot rolling process and the annealing process, C has the effect of refining the microstructure.

In other words, C has the effect of lowering a transformation point. As a result, in the hot rolling process, hot rolling can be completed in a lower-temperature range to refine the microstructure of the hot-rolled steel sheet. In an annealing step, due to the effect of C by which recrystallization of ferrite is suppressed in the course of temperature increase, it is facilitated to reach a temperature range of at least ($Ac_1$ point+10° C.) by rapid heating while maintaining a state with a high percentage of unrecrystallized ferrite. As a result, it becomes possible to refine the microstructure of a cold-rolled steel sheet.

If the C content is less than 0.06%, it is difficult to obtain the above-described effects. Accordingly, the C content is made at least 0.06%. It is preferably at least 0.08% and more preferably at least 0.10%. If the C content exceeds 0.3%, there is a marked decrease in workability and weldability. Accordingly, the C content is made at most 0.3%. Preferably it is at most 0.25%.

[Si: 0.6 to 2.5%]

Si has the effect of promoting the formation of hard phases such as martensite and bainite, which is a main phase of a cold-rolled steel sheet according to the present invention, and thereby increasing the strength of the steel. Furthermore, Si has the effect of promoting production of retained austenite and thereby increasing the ductility of the steel.

If the Si content is less than 0.6%, it is difficult to obtain the above-described effects. Therefore, the Si content is at least 0.6%, preferably at least 0.8%, further preferably at least 1.0%. On the other hand, if the Si content exceeds 2.5%, a substantial ductility decrease may occur or platability may be deteriorated. Accordingly, the Si content is at most 2.5%, preferably at most 2.0%.

[Mn: 0.6 to 3.5%]

Mn has the effect of increasing the strength of steel. Mn also has the effect of decreasing a transformation temperature. As a result, during an annealing step, it is facilitated to reach a temperature range of at least ($Ac_1$ point+10° C.) by rapid heating while maintaining a state with a high percentage of unrecrystallized ferrite, and it becomes possible to refine the microstructure of a cold-rolled steel sheet.

If the Mn content is less than 0.6%, it becomes difficult to obtain the above-described effects. Accordingly, the Mn content is made at least 0.6%. On the other hand, if the Mn content exceeds 3.5%, the strength of the steel is excessively increased, which may result in substantial ductility loss. Therefore, the Mn content is at most 3.5%.

[P: At Most 0.1%]

P, which is contained as an impurity, has the action of embrittling the material by segregation at grain boundaries. If the P content exceeds 0.1%, embrittlement due to the above action becomes marked. Accordingly, the P content is made at most 0.1%. Preferably it is at most 0.06%. The P content is preferably as low as possible, so it is not necessary to set a lower limit therefor. From the standpoint of costs, it is preferably at least 0.001%.

[S: At Most 0.05%]

S, which is contained as an impurity, has the action of lowering the ductility of steel by forming sulfide-type inclusions in steel. If the S content exceeds 0.05%, there may be a marked decrease in ductility due to the above-described action. Accordingly, the S content is made at most 0.05%. It is preferably at most 0.008% and more preferably at most 0.003%. The S content is preferably as low as possible, so it is not necessary to set a low limit therefor. From the standpoint of costs, it is preferably at least 0.001%.

[Ti: 0 to 0.08%, Nb: 0 to 0.04% and a Total of Ti and Nb: 0 to 0.10%]

Ti and Nb each have the effect of precipitating in steel as carbides or nitrides and suppressing austenite grain growth in the annealing step, thereby promoting refining the structure of the steel. Therefore, the chemical composition of the steel may contain either or both of Ti and Nb as desired.

However, if the content of each of the elements exceeds the above upper limit value or the total content exceeds the above upper limit value, a ductility may markedly decrease. Therefore, the content of each of the elements and the total content are set as above. Here, the Ti content is preferably at most 0.05%, further preferably at most 0.03%. Also, the Nb content is preferably at most 0.02%. The total content of Ti and Nb is preferably at most 0.05%, further preferably at most 0.03%. In order to obtain t the above effect with greater certainty, it is preferably to satisfy either of the conditions of at least 0.005% Ti and at least 0.003% Nb.

[sol.Al: 0 to 2.0%]

Al has the effect of increasing the ductility of steel. Accordingly, Al may be contained in the steel composition. However, since Al has the effect of increasing an $Ar_3$ transformation point, if the sol.Al content exceeds 2.0%, it becomes necessary to complete hot rolling in a higher temperature range. As a result, it becomes difficult to refine the structure of a hot-rolled steel sheet and it therefore becomes difficult to refine the structure of a cold-rolled steel sheet. In addition, continuous casting sometimes becomes difficult. Accordingly, the sol. Al content is made at most 2.0%. In order to obtain the above-described effect of Al with greater certainty, the sol. Al content is preferably at least 0.1%.

[Cr: 0 to 1%, Mo: 0 to 0.3% and V: 0 to 0.3%]

Cr, Mo and V each have the effect of increasing the strength of steel. Also, Mo has the effect of suppressing the growth of grains and refining the structure, and V has the effect of promoting transformation to ferrite and increasing the ductility of the steel sheet. Therefore, one or more of Cr, Mo and V may be contained.

However, if the Cr content exceeds 1%, the ferrite transformation may excessively be suppressed, and as a result, it is impossible to ensure a desired structure. Also, if the Mo content exceeds 0.3% or if the V content exceeds 0.3%, an amount of precipitates may increase in the heating step in the hot rolling process, which can substantially decrease the ductility. Accordingly, the contents of the respective elements are set as above. The Mo content is preferably at most 0.25%. In order to obtain the above effects with greater certainty, it is preferable to satisfy any of the conditions of at least 0.03% Cr, at least 0.01% Mo and at least 0.01% V.

[B: 0 to 0.005%]

B has the effect of increasing the hardenability of steel and promoting the formation of low-temperature transformation phases, thereby increasing the strength of the steel. Therefore, B may be contained. However, if the B content exceeds 0.005%, the steel excessively may harden, which can result in a significant ductility decrease. Therefore, the B content is at most 0.005%. In order to obtain the above effects with greater certainty, the B content is preferably at least 0.0003%.

[Ca: 0 to 0.003% and REM: 0 to 0.003%]

Ca and REM each have the effect of refining oxides and nitrides precipitated during solidification of molten steel and thereby increasing the soundness of a slab. Accordingly, one or more of these elements may be contained. However, each of these elements is expensive, so the content of each element is made at most 0.003%. The total content of these elements is preferably at most 0.005%. In order to obtain the above-described effects with greater certainty, the content of either element is preferably at least 0.0005%.

REM indicates the total of 17 elements including Sc, Y, and lanthanoids. Lanthanoids are industrially added in the form of a mish metal. The content of REM in the present invention means the total content of these elements.

The remainder other than the above is Fe and impurities.

1-2: Microstructure and Texture

[Main Phase]

A microstructure has a main phase of either or both of martensite and bainite which comprising at least 40 area % in total, which are hard low temperature transformation phases.

As a result of the main phase of either or both of martensite and bainite, which are hard low temperature transformation phases, the strength of the steel sheet can be increased, and in addition, the hardness distribution in the microstructure is equalized, the stretch flangeability of the cold-rolled steel sheet can be increased.

If the area fraction of the main phase is less than 40%, the hardness distribution in the structure becomes large in change, making fine cracks easily occur during working deformation, resulting in difficulty to achieve excellent stretch flangeability. Therefore, the area fraction of the main phase (martensite and/or bainite) is at least 40%. The area fraction is preferably at least 50%, more preferably at least 60%. The main phase does not need to contain both of martensite and bainite, and may contain only either of them or both of them. Bainite includes bainitic ferrite.

[Second Phase]

A second phase preferably contains at least 3 area % ferrite and satisfies above Equation (1). The second phase preferably further contains at least 3 area % retained austenite and satisfies above Equations (2) and (3).

If the second phase contains at least 3 area % ferrite, the ductility of the cold-rolled steel sheet can be increased. In this case, since an average grain diameter of ferrite defined by high angle grain boundaries with a tilt angle of at least 15° is at most 4.0 μm and thus, fine (that is, satisfies Equation (1) above), the formation and development of fine cracks during working of a steel sheet can effectively be suppressed, whereby the stretch flangeability of the cold-rolled steel sheet is further increased. Hereinafter, the average grain diameter of the ferrite defined by the high angle grain boundaries is simply referred to as "average grain diameter" of ferrite.

Since retained austenite (retained γ) has the effect of increasing the ductility of steel sheet, the ductility can be increased by increasing the area fraction of retained austenite. Setting the area fraction of retained austenite to at least 3% makes it easy to guarantee excellent ductility, and thus the second phase preferably contains at least 3% by area fraction of retained austenite. The area fraction of retained austenite is further preferably at least 5%. In this case, lump-like retained austenite having an aspect ratio of less than 5 (hereinafter simply referred to as "lump-like austenite") satisfies above Equations (2) and (3) (that is, a high area fraction, i.e., at least 50% by area fraction of lump-like austenite relative to the entire retained austenite is contained and an average grain diameter thereof is fine, i.e., at most 1.5 μm), and further excellent stretch flangeability can be guaranteed.

Because lump-like retained austenite occupying the majority of the retained austenite is fine, after transformation of the retained austenite to martensite during working of the cold-rolled steel sheet, the formed martensite is fine. Thus, the decrease in stretch flangeability caused by martensite transformation is prevented. Also, since lump-like retained austenite tends to be produced adjacent to ferrite, work hardening caused by strain induced transformation further appears noticeably. Thus, lump-like retained austenite has the highly effective for increasing the ductility, in particular, the uniform ductility and the n-value, compared to elongated ones having an aspect ratio exceeding 5, which are formed among laths of, e.g., martensite. Since the lump-like retained austenite having such properties occupies the majority of the retained austenite, the workability of the cold-rolled steel sheet can be improved. For the above reasons, the retained austenite contained in the second phase preferably satisfies above Equations (2) and (3), and more preferably satisfies following Equations (2a) and (3a):

$$d_{As} \leq 1.0 \quad \text{(2a); and}$$

$$r_{As} \geq 60 \quad \text{(3a).}$$

Here, although the second phase may be contaminated by pearlite and/or cementite, such contamination is allowed if a total area fraction of them is at most 10%.

An average grain diameter of ferrite that can be contained as the second phase is determined using an SEM-EBSD for those ferrite grains which are surrounded by high angle grain boundaries having a tilt angle of at least 15°. SEM-EBSD is a method of carrying out measurement of the orientation of a minute region by electron backscatter diffraction (EBSD) in a scanning electron microscope (SEM). It is possible to measure the grain diameter from the resulting orientation map.

The average grain diameter of the lump-like retained austenite having an aspect ratio of less than 5 can be calculated by a method similar to the above.

The area fractions of the main phase and the ferrite can be measured by structure analysis using SEM-EBSD. Also, the volume fraction of the retained austenite determined by X-ray diffraction is used as the area fraction of the retained austenite as it is.

In the present invention, the above-described average grain diameter and area fraction are the values measured at a depth of ¼ the sheet thickness of the steel sheet.

[Texture]

The cold-rolled steel sheet according to the present invention has a texture where ratio of the average of the X-ray intensities for {100}<011> to {211}<011> orientations relative to an average of the X-ray intensities of a random structure not having a texture is less than 6 at a depth of ½ the sheet thickness.

If the texture for {100}<011> to {211}<011> orientation grows, the workability of the steel decreases. Thus, the X-ray intensity ratio of the orientation group is decreased to decrease the workability of the steel. If the average of the X-ray intensities for the orientation group relative to the average of the X-ray intensities of the random structure not having a texture is at least 6, it is difficult to guarantee good ductility and stretch flangeability.

Therefore, the ratio of the average of the X-ray intensities of the orientations relative to the average of the X-ray intensities of the random structure not having a texture is less than 6. The ratio is preferably less than 5, more preferably less than 4. Here, {hkl}<uvw> of a texture represent an crystal orientation in which a vertical direction of the sheet and the normal to {hkl} are parallel to each other and a rolling direction and <uvw> are parallel to each other.

The X-ray intensity of the particular orientation can be obtained by chemically polishing the steel sheet to the depth of ½ the sheet thickness using hydrofluoric acid and subsequently measuring pole figures of the {200}, {110} and {211} planes of the ferrite phase on the sheet and analyzing an orientation distribution function (ODF) by series expansion method using the measurement values.

The X-ray intensities of the random structure not having a texture are determined by measurement like that described above using a powdered sample of the steel.

1-3: Plating Layer

With the object of improving corrosion resistance and the like, a plating layer may be provided on the surface of the above-described cold-rolled steel sheet to obtain a surface treated steel sheet. The plating layer may be an electroplated layer or a hot-dip plating layer. Examples of an electroplating are electrogalvanizing and Zn—Ni alloy electroplating. Examples of a hot-dip plating are hot-dip galvanizing, galvannealing, hot-dip aluminum plating, hot-dip Zn—Al alloy plating, hot-dip Zn—Al—Mg alloy plating, and hot-dip Zn—Al—Mg—Si alloy plating. The plating weight is not limited, and it may be a usual value. It is also possible to form a suitable chemical conversion treatment coating on the plating surface (such as one formed by applying a silicate-based chromium-free chemical conversion solution followed by drying) to further improve corrosion resistance. It is also possible to cover the plating with an organic resin coating.

2. Process for Manufacturing 2-1: Hot Rolling and Cooling after Rolling

In the present invention, the structure of the cold-rolled steel sheet is refined by the below-described annealing, and thus, a hot-rolled steel sheet provided for cold rolling may be carried out in a conventional manner. However, in order to further refine the structure of the cold-rolled steel sheet, it is preferable to refine the structure of a hot-rolled steel sheet provided for cold rolling to increase nucleus forming sites for austenitic transformation. More specifically, this means refining grains surrounded by high angle grain boundaries having a tilt angle of at least 15° and refined dispersion of the second phase such as cementite and/or martensite.

When a hot-rolled steel sheet having a fine structure is subjected to cold rolling and then to annealing by rapid heating, nucleus forming site disappearance due to recrystallization in a heating process can be suppressed by the rapid heating, and thus, the number of nuclei formed in austenite and recrystallized ferrite increases, and it is facilitated to refine the final structure.

In the present invention, a hot-rolled steel sheet that is preferable for a starting material for a cold-rolled steel sheet specifically has an average grain diameter of the BCC phase defined by high angle grain boundaries having a tilt angle of at least 15°, namely at most 6 μm. The average grain diameter of the BCC phase is further preferably at most 5 μm. This average grain diameter can also be obtained by SEM-EBSD.

If the average grain diameter of the BCC phase in the hot-rolled steel sheet is at most 6 μm, the cold-rolled steel sheet can further be refined to further improve mechanical property. Here, since the average grain diameter of the BCC phase in the hot-rolled steel sheet is preferably as small as possible, a lower limit is not recited, but the average grain diameter is normally at least 1.0 μm. The BCC phase mentioned here may include ferrite, bainite and martensite, and consists of one or more of ferrite, bainite and martensite. Martensite is precisely not a BCC phase, but is included in a BCC phase in the Description considering that the aforementioned average grain diameter is obtained by a SEM-EBSD analysis.

Such a hot-rolled steel sheet having a fine structure can be manufactured by performing hot rolling and cooling by the method described below.

A slab having the above-described chemical composition is manufactured by continuous casting, and is provided for hot rolling. Here, the slab may be used in a high temperature state after the continuous casting or may be first cooled to room temperature and then reheated.

The temperature of the slab which is subjected to hot rolling is preferably at least 1000° C. If the heating temperature of the slab is lower than 1000° C., excessive load is imposed on a rolling mill, and further, the temperature of the steel may decrease to a ferrite transformation temperature during rolling, whereby the steel can be rolled in a state in which transformed ferrite contained in the structure. Therefore, the heating temperature of the slab is preferably sufficiently high so that hot rolling can be completed in the austenite temperature range.

The hot rolling is preferably carried out using a reverse mill or a tandem mill. From the standpoint of industrial productivity, it is preferable to use a tandem mill for at least the final number of stands. Since it is necessary to maintain the steel sheet in the austenite temperature range during rolling, the temperature at the completion of the rolling is preferably made at least the $Ar_3$ point.

Rolling reduction in hot rolling is preferably such that the percent reduction in the sheet thickness when the slab temperature is in the temperature range from the $Ar_3$ point to ($Ar_3$ point+150° C.) is at least 40%. The percent reduction in thickness is more preferably at least 60%. It is not necessary to carry out rolling in one pass, and rolling may be carried out by a plurality of sequential passes. Increasing the rolling reduction is preferable because it can introduce a larger amount of strain energy into austenite, thereby increasing the driving force for transformation to BCC phase and refining BCC phase more greatly. However, doing so increases the load on rolling equipment, so the upper limit on the rolling reduction per pass is preferably 60%.

Cooling after the completion of the rolling is preferably carried out by the method described in detail below.

Cooling from the temperature at the completion of rolling is preferably carried out at a cooling rate (Crate) satisfying Equation (4) below in a temperature range from the temperature at the completion of rolling to (temperature at the completion of rolling −100° C.).

$$IC(T) = 0.1 - 3\times10^{-3}\cdot T + 4\times10^{-5}\cdot T^2 - 5\times10^{-7}\cdot T^3 + 5\times10^{-9}\cdot T^4 - 7\times10^{-11}\cdot T^5 \int_0^{-100} \frac{-dT}{\mathrm{Crate}(T)\cdot IC(T)} < 4 \quad (4)$$

The meanings of the symbols in the equation have been stated above.

Equation (4) above indicates a condition to be cooled to an austenite unrecrystallization temperature range (temperature at the completion of rolling −100° C.) before strain energy accumulated in the steel sheet during hot rolling is consumed by recovery and recrystallization after completion of the hot rolling. More specifically, IC (T) is a value that can be obtained by calculation of body diffusion of Fe atoms, and represents a period of time from completion of hot rolling to a start of recovery of austenite. Furthermore, (1/(Crate(T)·IC(T))) is a value of a period of time required for cooling by 1° C. at a cooling rate (Crate(T)), the period of time being normalized by IC(T), that is, represents a fraction of cooling time relative to a period of time until disappearance of strain energy by recovery and recrystallization. Therefore, a value that can be obtained by integrating (1/Crate(T)·IC(T)) in a range of T=0 to −100° C. serves as an index representing an amount of strain energy disappeared during cooling. By limiting the value, cooling conditions (cooling rate and holding time) required for cooling by 100° C. before disappearance of a certain amount of strain energy. The value of the right side of Equation (4) is preferably 3.0, more preferably 2.0, further preferably 1.0.

In a preferred cooling method satisfying above Equation (4), primary cooling is preferably started from the temperature at the completion of rolling at a cooling rate of at least 400° C./sec and is preferably carried out in a temperature range of at least 30° C. at this cooling rate. The temperature range is preferably at least 60° C. If a water cooling stop time which will be described later is not set, the temperature range is further preferably at least 100° C. The cooling rate for the primary cooling is more preferably at least 600° C./sec, particularly preferably at least 800° C./sec.

The primary cooling can be started after holding at the temperature at the completion of rolling for a short length of time of at most 5 seconds. The time from completion of the rolling to start of the primary cooling is preferably less than 0.4 seconds so as to satisfy above Equation (4).

Also, water cooling is preferably started at a cooling rate of at least 400° C./sec (preferably at least 600° C./sec, more preferably at least 800° C./sec), and is carried out at this cooling rate in a temperature range of at least 30° C. and at most 80° C., and then a water cooling stop period of at least 0.2 seconds and at most 1.5 seconds (preferably at most 1 second) is set, and during that period, the sheet shape such as the sheet thickness or sheet width are measured, and after that, cooling (secondary cooling) is carried out at a rate of at least 50° C./sec. Since feedback of the sheet shape can be controlled by such sheet shape measurement, the productivity is improved. During the water cooling stop period, the sheet may be subjected to natural cooling or air cooling.

Industrially, the primary cooling and secondary cooling above are carried out by water cooling.

When the cooling conditions for cooling from the temperature at the completion of rolling to the temperature of (temperature at the completion of rolling −100° C.) satisfy above Equation (4), the consumption of the strain by recovery and recrystallization introduced to austenite as a result of the hot rolling, can be suppressed as much as possible, as a result, the strain energy accumulated in the steel can be used as a driving force for transformation from austenite to the BCC phase to a maximum extent. A reason to make the cooling rate of the primary cooling from the temperature at the completion of rolling at least 400° C./sec is also the same as above, that is, an increase in the transformation driving force. Consequently, an amount of formed nuclei for transformation from austenite to the BCC phase increases, thereby refining the structure of the hot-rolled steel sheet. By using a hot-rolled steel sheet having a fine structure manufactured as described above for a starting material, the structure of the cold-rolled steel sheet can further be refined.

After the primary cooling, or the primary cooling and the secondary cooling have been carried out as described above, structure control such as ferrite transformation or precipitation of fine grains consisting of Nb and/or Ti may be carried out by holding the temperature of the steel sheet in an desired temperature range for an desired length of time before cooled to a coiling temperature. The "holding" mentioned here includes natural cooling and retaining heat. Considering the temperature and the holding time suitable for the structure control, for example, natural cooling is carried out in a temperature range of 600° C. to 680° C. for around 3 to 15 seconds, which can introduce fine ferrite to the hot-rolled sheet structure.

Subsequently, the steel sheet is cooled to the coiling temperature. For a cooling method in this step, cooling can be carried out at a desired cooling rate by a method selected from water cooling, mist cooling and gas cooling (including air cooling). The coiling temperature for the steel sheet is preferably at most 650° C. from the standpoint of refining the structure with greater certainty.

The hot-rolled steel sheet manufactured by the above heat-rolling process has a structure in which a sufficiently large number of high angle grain boundaries has been introduced, an average grain diameter of grains defined by high angle grain boundaries having a tilt angle of at least 15° is at most 6 μm and second phases such as martensite and/or cementite are finely dispersed. As described above, it is favorable that the hot-rolled steel sheet in which a large number of high angle grain boundaries exists and the second phases are finely dispersed, is subjected to cold rolling and annealing. This is because since these high angle grain boundaries and fine second phases are preferred nucleus forming sites for austenitic transformation, the structure can be refined by producing a large number of austenite and recrystallized ferrite from these positions by rapid heating annealing.

The structure of the hot-rolled steel sheet can be a ferrite structure containing pearlite as a second phase, a structure consisting of bainite and martensite, or a structure of a mixture thereof.

2-2: Heat Treatment of Hot-Rolled Steel Sheet

The above hot-rolled steel sheet may be subjected to annealing at a temperature of 500° C. to 700° C. The annealing is particularly suitable for a hot-rolled steel sheet coiled at a temperature of at most 300° C.

The annealing can be carried out by a method in which a heat-rolled coil is made to pass through a continuous annealing line or a method in which the coil is put as it is in a batch annealing furnace. In heating the hot-rolled steel sheet, a heating rate up to an annealing temperature of 500° C. can be a desirable rate in a range from slow heating of around 10° C./hour to rapid heating of 30° C./sec.

A soaking temperature (annealing temperature) is in a temperature range of 500° C. to 700° C. A holding time in this temperature range does not need to be specifically limited; however, the holding time is preferably at least 3 hours. From the standpoint of suppressing coarsening of carbide, an upper limit of the holding time is preferably at most 15 hours, more preferably at most 10 hours.

As a result of such annealing of the hot-rolled steel sheet, fine carbides can be dispersed in the grain boundaries, the packet boundaries and the block boundaries in the hot-rolled steel sheet, and carbides can further finely be dispersed by a combination of the annealing and the above-described rapid cooling for an extremely short length of time immediately after completion of hot rolling. As a result, austenite nucleus forming sites can be increased during annealing to refine a final structure. The annealing of the hot-rolled steel sheet also has the effect of softening the hot-rolled steel sheet to decrease the load on the cold rolling equipment.

2-3: Pickling and Cold Rolling

The hot-rolled steel sheet manufactured by the method described above is subjected to pickling and then to cold rolling. Each of the pickling and the cold rolling may be carried out in a conventional manner. The cold rolling can be carried out using lubricating oil. The cold rolling ratio does not need to be specifically determined, but is normally at least 20%. If the cold rolling reduction exceeds 85%, load on the cold rolling equipment becomes large, and thus, the cold rolling ratio is preferably at most 85%.

2-4: Annealing

A cold-rolled steel sheet which is obtained by the above-described cold rolling is subjected to annealing by heating at an average heating rate of at least 15° C./sec so that the unrecrystallization ratio of a region not transformed to austenite at a point of time of reaching ($Ac_1$ point+10° C.) is at least 30%.

As described above, by heating up to ($Ac_1$ point+10° C.) in a state in which unrecrystallization structure remains, a large number of fine austenite nuclei to be formed as the high angle grain boundaries and/or the second phases of the hot-rolled steel sheet as nucleus forming sites. Here, the hot-rolled steel sheet preferably has a fine structure because a large number of nuclei can be formed. The increase in the number of austenite nuclei formed enables significantly refining austenite grains during the annealing, enabling refining ferrite, low-temperature transformation phases and retained austenite, which are produced subsequently.

On the other hand, if the unrecrystallization ratio of the region not transformed to austenite at the time of reaching ($Ac_1$ point+10° C.) is less than 30%, in most regions, austenitic transformation have been promoted after completion of recrystallization. As a result, in such regions, austenitic transformation is promoted from the grain boundaries of the recrystallized grains, and thus, the austenite grains during annealing are coarsened and the final structure is also coarsened.

Therefore, the average heating rate is at least 15° C./sec so that the unrecrystallization ratio of the regions not transformed to austenite at the time of reaching ($Ac_1$ point+10°

C.) becomes at least 30 area %. The average heating rate is preferably at least 30° C./sec, further preferably at least 80° C./sec, particularly preferably at least 100° C./sec. An upper limit of the average heating rate is not specifically defined, but is preferably at most 1000° C./sec to avoid temperature control difficulty.

The above temperature for starting the rapid heating at a rate of at least 15° C./sec may be any desired temperature if the recrystallization has not started yet, and may be, $T_s$−30° C. relative to a the temperature for the start of softening (the temperature for the start of recrystallization) T, measured under a heating rate of 10° C./sec. The heating rate in the temperature range before such temperature is reached can arbitrarily be determined. For example, even if rapid heating is started from around 600° C., effect of sufficiently refining grain can be obtained. Also, even if rapid heating is started from room temperature, nit does not have an adverse effect on the cold-rolled steel sheet after annealing.

It is preferable to use electrical heating, resistance heating or induction heating in order to obtain a sufficiently rapid heating rate, but as long as the above-described temperature increase conditions are satisfied, it is also possible to adopt heating by a radiant tube. By using such a heating device, the time for heating a steel sheet is greatly decreased, and it is possible to make annealing equipment more compact, whereby effects such as a decrease in investment in equipment can be expected. It is also possible to add a heating device to an existing continuous annealing line or a hot-dip plating line to carry out the heating.

After heating to ($Ac_1$ point+10° C.), heating is further carried out to an annealing temperature (soaking temperature) in a range of at least (0.3×$Ac_1$ point+0.7×$Ac_3$ point) and at most ($Ac_3$ point+100° C.). The heating rate in this temperature range can be any desired rate. Decreasing a heating rate can obtain sufficient time to promote recrystallization of ferrite. Also, the heating rate can be varied in such a manner that rapid heating (for example, at a rate that is the same as that of the above rapid heating) is first carried out at any in the temperature range and subsequently the heating rate is lowered.

In the annealing process, transformation to austenite is sufficiently promoted to eliminate the deformed ferrite structure and dissolve carbides in the steel sheet. Thus, the annealing temperature is at least (0.3×$Ac_1$+0.7×$Ac_3$ point). If annealing is carried out at a temperature that is lower than that annealing temperature, a single-phase austenite state is not achieved during the annealing or recrystallization of ferrite does not occur, and as a result, deformed ferrite structure retaining. In this case, in the texture of the cold-rolled steel sheet, the orientation group from {100}<011> to {211}<011> becomes stronger, resulting in a decrease in workability of the steel sheet. On the other hand, if annealing is carried out at a temperature exceeding ($Ac_3$ point+100° C.), abrupt grain growth takes place, resulting in coarsening of the final structure. Thus, the annealing temperature is at most ($Ac_3$ point+100° C.), preferably (at most $Ac_3$ point+50° C.).

The $Ac_1$ and $Ac_3$ points in the present invention are values that can be determined from a thermal expansion chart measured when the temperature of the steel sheet which was cold rolled is heated to 1100° C. at a heating rate of 2° C./sec.

If an annealing holding time (soaking holding time) for the temperature range is at most 30 seconds, dissolution of the carbides and transformation to austenite are not sufficiently promoted, resulting in a decrease in workability of the cold-rolled steel sheet. Also, temperature unevenness during the annealing easily occurs, causing a problem in production stability. Therefore, it is necessary to determine an annealing holding time of at least 30 seconds to sufficiently promote transformation to austenite. An upper limit of the holding time is not specifically determined; however, excessively-long time holding makes it difficult to satisfy a final grain diameter of at most 5 μm, which is required in the present invention, because of growth of austenite grains, and thus, the annealing holding time is preferably less than 10 minutes.

Cooling after the soaking is carried out at a cooling rate of at least 10° C./sec for a temperature range of at most 650° C. and at least 500° C. Setting the cooling rate for the temperature range to at least 10° C./sec can increase area fraction of low temperature transformation phases in the structure of the cold-rolled steel sheet. On the other hand, if the cooling rate is less than 10° C./sec, a large amount of ferrite is formed during the cooling, resulting in deterioration in stretch flangeability. Thus, the cooling rate for the temperature range after the annealing is at least 10° C./sec, preferably at least 20° C./sec.

During the cooling, overaging heat treatment or hot-dip plating (e.g., hot-dip galvanizing or alloying hot-dip galvanizing) can be carried out. By controlling, e.g., the soaking temperature and holding time, low temperature transformation phases having an appropriate area fraction are formed in the cold-rolled steel sheet and diffusion of carbon atoms to untransformed austenite is promoted to produce retained austenite. Heat treatment conditions preferable for overaging are a temperature range of 300° C. to 500° C. and a holding time range of 100 to 600 seconds.

Because of an excessively-low cooling rate and/or high-temperature and long-time soaking, it is impossible to obtain a desired structure fraction and workability of the steel sheet deteriorates because of transformation of retained austenite to carbides.

Thus, the holding time (including plating and/or overaging) during cooling is preferably less than 2000 seconds. The cooling method can be various methods such as gas, mist or water cooling.

EXAMPLES

Each ingot of steel types A to M each having the chemical composition indicated in Table 1 was melted in a vacuum induction furnace. Table 1 indicates $Ac_1$ and $Ac_3$ points for each of steel types A to M. These transformation temperatures are determined from a thermal expansion chart measured when a steel sheet subjected to cold rolling under the below-described manufacturing conditions was heated to 1100° C. at a heating rate of 2° C./sec. Table 1 also indicates each value of ($Ac_1$ point+10° C.), (0.3×$Ac_1$ point+0.7×$Ac_3$ point) and ($Ac_3$ point+100° C.).

TABLE 1

| Steel type | C | Si | Mn | P | S | Ti | Nb | sol.Al | Others | $Ac_1$ (° C.) | $Ac_3$ (° C.) | $Ac_1$ + 10 (° C.) | $0.3Ac_1 + 0.7Ac_3$ (° C.) | $Ac_3$ + 100 (° C.) |
|---|---|---|---|---|---|---|---|---|---|---|---|---|---|---|
| A | 0.175 | 1.22 | 2.51 | 0.008 | 0.001 | — | 0.010 | — | — | 721 | 838 | 731 | 802.9 | 938 |
| B | 0.179 | 1.23 | 1.92 | 0.010 | 0.002 | — | 0.010 | — | Cr: 0.29 | 728 | 858 | 738 | 819 | 958 |
| C | 0.177 | 1.01 | 2.21 | 0.004 | 0.001 | — | 0.010 | — | Mo: 0.20 | 723 | 829 | 733 | 797.2 | 929 |
| D | 0.176 | 1.13 | 2.49 | 0.003 | 0.001 | — | 0.011 | 0.15 | — | 721 | 844 | 731 | 807.1 | 944 |
| E | 0.148 | 1.78 | 2.49 | 0.009 | 0.002 | — | — | — | Ca: 0.0011 | 719 | 863 | 729 | 819.8 | 963 |
| F | 0.201 | 1.23 | 2.19 | 0.003 | 0.002 | 0.03 | — | — | — | 713 | 843 | 723 | 804 | 943 |
| G | 0.182 | 1.27 | 1.93 | 0.010 | 0.001 | — | 0.011 | — | REM: 0.0010 | 722 | 872 | 732 | 827 | 972 |
| H | 0.235 | 1.26 | 2.82 | 0.010 | 0.001 | — | — | — | — | 705 | 832 | 715 | 793.9 | 932 |
| I | 0.119 | 0.98 | 2.91 | 0.011 | 0.001 | 0.02 | 0.010 | — | B: 0.0009 | 714 | 831 | 724 | 795.9 | 931 |
| J | 0.072 | 0.72 | 2.79 | 0.011 | 0.001 | — | 0.005 | — | V: 0.20 | 711 | 842 | 721 | 802.7 | 942 |
| K | 0.181 | 1.03 | 2.23 | 0.011 | 0.001 | — | 0.123 | — | — | 722 | 849 | 732 | 810.9 | 949 |
| L | 0.143 | 0.06 | 0.71 | 0.011 | 0.001 | — | — | — | — | 712 | 836 | 722 | 798.8 | 936 |
| M | 0.062 | 1.01 | 3.15 | 0.004 | 0.001 | — | 0.010 | — | — | 701 | 792 | 711 | 764.7 | 892 |

An underline means that the relevant steel type or value falls outside the scope of the invention.

The resulting ingots underwent hot forging, and then they were cut to the shape of slabs in order to subject them to hot rolling. These slabs were heated for approximately one hour to a temperature of at least 1000° C. and then hot rolling was carried out at the hot temperature at the completion of rolling indicated in Table 2, using a small test mill for trials. After the rolling completion, a hot-rolled steel sheet having a sheet thickness of 2.0 to 2.6 mm was manufactured under the cooling time, water cooling rate and coiling temperature conditions indicated in the table.

The cooling after completion of the rolling were all water cooling and were each carried out by any of the following methods:

1) carrying out only primary cooling for a temperature decrease amount of at least 100° C. immediately after completion of the rolling;

2) carrying out only primary cooling for a temperature decrease amount of at least 100° C. after holding (natural cooling) at the temperature at the completion of rolling (FT) for a predetermined period of time; and 3) carrying out primary cooling immediately after completion of the rolling, stopping the primary cooling when the relevant steel sheet was cooled by 30° C. to 80° C. from the temperature at the completion of rolling (FT), and held at the temperature (allowed to naturally cool) for a predetermined length of time, and then carrying outing secondary cooling.

The steel sheet was naturally cooled for 3 to 15 seconds after stoppage of primary cooling if primary cooling was carried out alone, and after stoppage of secondary cooling if secondary cooling was carried out, and subsequently was water cooled at a cooling rate of 30° C. to 100° C./sec to the coiling temperature. Subsequently, the steel sheet was put in a furnace and subjected to slow cooling simulated for coiling. A value of the left side of Equation (4) and an average grain diameter of a BCC phase of the hot-rolled steel sheet are also indicated in Table 2.

Measurement of an average grain diameter of a BCC phase in the hot-rolled steel sheet was carried out by analyzing grain diameters of the BCC phase defined by high angle grain boundaries having a tilt angle of at least 15° in a cross-section of the structure of the steel sheet, the cross-section being parallel to a rolling direction and the sheet thickness direction of the steel sheet, using an SEM-EBSD apparatus (JSM-7001F manufactured by JEOL Ltd.). The average grain diameter d of the BCC phase was obtained using following Equation (5). Here, Ai represents the area of an i-th grain, and di represents a Heywood diameter of the i-th grain.

$$d = \frac{\sum_i Ai \times di}{\sum_i Ai} \tag{5}$$

For some of the hot-rolled steel sheets, hot-rolled plate annealing was carried out under the conditions indicated in Table 2 using a heating furnace.

Each of the hot-rolled steel sheets obtained as described above was subjected to pickling using a hydrochloric acid and cold rolling at the rolling reduction indicated in Table 2 in a conventional manner to make the steel sheet have a thickness of 1.0 to 1.2 mm. Subsequently, using a laboratory scale annealing equipment, annealing was carried out at the heating rate, the soaking temperature (annealing temperature) and the soaking time (holding time) indicated in Table 2, and cooling was carried out under a condition that makes the cooling rate for a temperature range of from 650° C. to 500° C. become the "Cooling rate" indicated in Table 2, whereby the resulting cold-rolled steel sheet was obtained. Cooling after the soaking was carried out using a nitrogen gas. Furthermore, in a cooling process, as indicated in Table 2, each steel sheet was subjected to any of heat treatments indicated in A to I below, which are simulated for overaging or alloying hot-dip galvanizing, and then cooled to room temperature at 2° C./sec, whereby the resulting cold-rolled steel sheet was obtained. Conditions for these heat treatments were indicated below.

A: Holding at 375° C. for 330 seconds

B: Holding at 400° C. for 330 seconds

C: Holding at 425° C. for 330 seconds

D: holding at 480° C. for 15 seconds, then cooling to 460° C. for simulation of hot-dip galvanizing bath immersion, and further heating to 500° C. for simulation of alloying E: Holding at 480° C. for 60 seconds, then cooling to 460° C. for simulation of hot-dip galvanizing bath immersion, and further heating to 520° C. for simulation of alloying F: Holding at 480° C. for 60 seconds, then cooling to 460° C. for simulation of hot-dip galvanizing bath immersion, and further heating to 540° C. for simulation of alloying.

Table 2 indicates a proportion of an unrecrystallization of regions not transformed to austenite in ferrite at the time of reaching ($Ac_1$ point+10° C.). This value was obtained by the following method. In other words, each steel sheet that has been subjected to cold rolling according to the manufacturing conditions in the present invention was heated to the temperature ($Ac_1$ point+10° C.) at the heating rate indicated in the relevant steel sheet number and then immediately cooled by water cooling. The structure of the steel sheet was photographed using an SEM, and on the structure photograph, the fractions of a recrystallization structure and a deformed structure of each of regions except martensite, that is, regions other than regions transformed to austenite at the time of reaching ($Ac_1$ point+10° C.) were measured to obtain the proportion of the unrecrystallization.

TABLE 2

| | | Hot rolling | | | | | | | | | Hot-rolled sheet annealing | | Cold rolling and annealing | | | | | | | |
|---|---|---|---|---|---|---|---|---|---|---|---|---|---|---|---|---|---|---|---|---|
| | | | | | | Temperature holding* | | | | | | | | Annealing | | | | | | |
| Steel sheet No. | Steel type | Temperature of completion of rolling ° C. | Primary water cooling rate ° C./s | Primary cooling temperature decrease ° C. | Secondary water cooling rate ° C./s | Holding temperature ° C. | Holding time sec | Value of left side of Equation (4) | Hot-rolled sheet average grain diameter μm | Coiling temperature ° C. | Annealing temperature ° C. | Detention period for 500° C. to 700° C. hr | Cold-rolling reduction rate % | Heating rate ° C./s | Soaking temperature ° C. | Soaking time sec | Cooling rate ° C./s | Proportion of uncrystallization at Ac1 point + 10° C. % | Treatment after annealing | Remarks |
| 1 | A | 895 | 1210 | 235 | — | — | — | 0.23 | 4.9 | 500 | — | — | 50 | 30 | 850 | 95 | 40 | 85 | C | Example of invention |
| 2 | A | 895 | 1210 | 235 | — | — | — | 0.23 | 4.9 | 500 | — | — | 50 | 200 | 850 | 95 | 40 | 100 | C | Example of invention |
| 3 | A | 895 | 1210 | 235 | — | — | — | 0.23 | 4.9 | 500 | — | — | 50 | 30 | 820 | 95 | 40 | 85 | B | Example of invention |
| 4 | A | 895 | 1210 | 235 | — | — | — | 0.23 | 4.9 | 500 | — | — | 50 | 150 | 950 | 95 | 40 | 100 | C | Comparative example |
| 5 | A | 900 | 870 | 80 | 170 | 820 | 0.75 | 0.54 | 5.2 | 500 | — | — | 50 | 2 | 850 | 95 | 40 | 0 | C | Comparative example |
| 6 | A | 900 | 870 | 80 | 170 | 820 | 0.75 | 0.54 | 5.2 | 500 | — | — | 50 | 30 | 850 | 95 | 40 | 85 | C | Example of invention |
| 7 | A | 900 | 870 | 80 | 170 | 820 | 0.75 | 0.54 | 5.2 | 500 | — | — | 50 | 30 | 830 | 95 | 40 | 85 | C | Example of invention |
| 8 | A | 895 | 200 | 190 | — | 895 | 3.00 | 31.00 | 9.8 | 500 | — | — | 50 | 2 | 850 | 95 | 40 | 0 | C | Comparative invention |
| 11 | B | 900 | 920 | 190 | — | — | — | 0.30 | 5.1 | 500 | — | — | 50 | 2 | 865 | 95 | 20 | 0 | E | Comparative example |
| 12 | B | 900 | 920 | 190 | — | — | — | 0.30 | 5.1 | 500 | — | — | 50 | 50 | 865 | 95 | 20 | 90 | E | Example of invention |
| 13 | B | 900 | 920 | 190 | — | — | — | 0.30 | 5.1 | 500 | — | — | 50 | 50 | 845 | 95 | 20 | 90 | F | Example of invention |
| 14 | B | 900 | 180 | 180 | — | 900 | 3.50 | 37.00 | 10.6 | 500 | — | — | 50 | 2 | 865 | 95 | 20 | 0 | E | Comparative invention |
| 16 | B | 900 | 920 | 190 | — | — | — | 0.30 | 5.1 | 150 | 600 | 7.0 | 50 | 2 | 865 | 95 | 40 | 0 | B | Comparative example |
| 17 | B | 900 | 920 | 190 | — | — | — | 0.30 | 5.1 | 150 | 600 | 7.0 | 50 | 30 | 865 | 95 | 40 | 85 | A | Example of invention |
| 18 | B | 900 | 920 | 50 | 170 | 850 | 2.00 | 3.30 | 5.5 | 150 | 600 | 7.0 | 50 | 50 | 845 | 95 | 40 | 90 | B | Example of invention |
| 19 | C | 900 | 1130 | 240 | — | — | — | 0.24 | 5.0 | 500 | — | — | 50 | 2 | 850 | 95 | 40 | 0 | B | Comparative example |
| 20 | C | 900 | 1130 | 240 | — | — | — | 0.24 | 5.0 | 500 | — | — | 50 | 150 | 850 | 95 | 40 | 100 | C | Example of invention |
| 21 | C | 900 | 1130 | 240 | — | — | — | 0.24 | 5.0 | 500 | — | — | 50 | 150 | 830 | 95 | 40 | 100 | C | Example of invention |
| 22 | D | 900 | 1210 | 235 | — | — | — | 0.23 | 5.0 | 500 | — | — | 50 | 10 | 850 | 95 | 40 | 15 | C | Comparative |

TABLE 2-continued

| Steel sheet No. | Steel type | Hot rolling: Temperature of completion of rolling ° C. | Hot rolling: Primary water cooling rate ° C./s | Hot rolling: Primary cooling temperature decrease ° C. | Hot rolling: Secondary water cooling rate ° C./s | Hot rolling: Temperature holding*: Holding temperature ° C. | Hot rolling: Temperature holding*: Holding time sec | Value of left side of Equation (4) | Hot-rolled sheet average grain diameter μm | Hot rolling: Coiling temperature ° C. | Hot-rolled sheet annealing: Annealing temperature ° C. | Hot-rolled sheet annealing: Detention period for 500° C. to 700° C. hr | Cold rolling and annealing: Cold-rolling reduction rate % | Cold rolling and annealing: Annealing: Heating rate ° C./s | Cold rolling and annealing: Annealing: Soaking temperature ° C. | Cold rolling and annealing: Annealing: Soaking time sec | Cold rolling and annealing: Annealing: Cooling rate ° C./s | Cold rolling and annealing: Proportion of uncrystallization at Ac1 point + 10° C. % | Cold rolling and annealing: Treatment after annealing | Remarks |
|---|---|---|---|---|---|---|---|---|---|---|---|---|---|---|---|---|---|---|---|---|
| | | | | | | | | | | | | | | | | | | | | example |
| 23 | D | 900 | 1210 | 235 | — | — | — | 0.23 | 5.0 | 500 | — | — | 50 | 30 | 850 | 95 | 40 | 85 | C | Example of invention |
| 24 | D | 900 | 1210 | 235 | — | — | — | 0.23 | 5.0 | 500 | — | — | 50 | 150 | 830 | 95 | 40 | 100 | B | Example of invention |
| 25 | E | 890 | 880 | 70 | 170 | 820 | 1.00 | 0.82 | 4.8 | 150 | 600 | 7.0 | 50 | 2 | 870 | 95 | 40 | 0 | C | Comparative example |
| 26 | E | 890 | 880 | 70 | 170 | 820 | 1.00 | 0.82 | 4.8 | 150 | 600 | 7.0 | 50 | 30 | 870 | 95 | 40 | 85 | C | Example of invention |
| 27 | E | 890 | 880 | 70 | 170 | 820 | 1.00 | 0.82 | 4.8 | 150 | 600 | 7.0 | 50 | 30 | 770 | 95 | 40 | 85 | B | Comparative example |
| 28 | F | 895 | 1210 | 230 | — | — | — | 0.23 | 5.1 | 500 | — | — | 50 | 2 | 850 | 95 | 40 | 0 | B | Comparative example |
| 29 | F | 895 | 1210 | 230 | — | — | — | 0.23 | 5.1 | 500 | — | — | 50 | 30 | 850 | 95 | 40 | 85 | B | Example of invention |
| 30 | F | 895 | 1210 | 230 | — | — | — | 0.23 | 5.1 | 500 | — | — | 50 | 30 | 950 | 95 | 40 | 85 | B | Comparative example |
| 31 | F | 895 | 1210 | 230 | — | — | — | 0.23 | 5.1 | 500 | — | — | 50 | 100 | 830 | 95 | 40 | 100 | B | Example of invention |
| 32 | F | 895 | 1210 | 230 | — | — | — | 0.23 | 5.1 | 500 | — | — | 50 | 30 | 850 | 95 | 20 | 85 | F | Example of invention |
| 33 | F | 895 | 1210 | 230 | — | — | — | 0.23 | 5.3 | 150 | 600 | 7.0 | 50 | 10 | 850 | 95 | 20 | 15 | E | Comparative example |
| 34 | F | 895 | 1210 | 230 | — | — | — | 0.23 | 5.3 | 150 | 600 | 7.0 | 50 | 30 | 830 | 95 | 20 | 85 | E | Example of invention |
| 35 | G | 900 | 980 | 250 | — | — | — | 0.28 | 5.6 | 400 | — | — | 50 | 2 | 880 | 95 | 40 | 23 | C | Comparative example |
| 36 | G | 900 | 980 | 250 | — | — | — | 0.28 | 5.6 | 400 | — | — | 50 | 30 | 855 | 95 | 40 | 100 | A | Example of invention |
| 37 | H | 900 | 1210 | 235 | — | — | — | 0.23 | 4.8 | 500 | — | — | 50 | 2 | 850 | 95 | 20 | 0 | D | Comparative example |
| 38 | H | 900 | 1210 | 235 | — | — | — | 0.23 | 4.8 | 500 | — | — | 50 | 30 | 850 | 95 | 20 | 85 | D | Example of invention |
| 39 | H | 900 | 1210 | 235 | — | — | — | 0.23 | 4.8 | 500 | — | — | 50 | 30 | 820 | 95 | 20 | 85 | D | Example of invention |
| 40 | H | 900 | 1210 | 235 | — | — | — | 0.23 | 5.0 | 150 | 600 | 7 | 50 | 30 | 820 | 200 | 20 | 85 | B | Example of invention |
| 41 | I | 810 | 840 | 190 | — | — | — | 0.33 | 2.1 | 150 | — | — | 55 | 10 | 820 | 60 | 50 | 23 | B | Comparative example |

TABLE 2-continued

| | | Hot rolling | | | | | | | | | Hot-rolled sheet annealing | | Cold rolling and annealing | | | | | | | |
|---|---|---|---|---|---|---|---|---|---|---|---|---|---|---|---|---|---|---|---|---|
| | | | | | | Temperature holding* | | | | | | | | Annealing | | | | | | |
| Steel sheet No. | Steel type | Temperature of completion of rolling ° C. | Primary water cooling rate ° C./s | Primary cooling temperature decrease ° C. | Secondary water cooling rate ° C./s | Holding temperature ° C. | Holding time sec | Value of left side of Equation (4) | Hot-rolled sheet average grain diameter μm | Coiling temperature ° C. | Annealing temperature ° C. | Detention period for 500° C. to 700° C. hr | Cold-rolling reduction rate % | Heating rate ° C./s | Soaking temperature ° C. | Soaking time sec | Cooling rate ° C./s | Proportion of uncrystallization at Ac1 point + 10° C. % | Treatment after annealing | Remarks |
| 42 | I | 810 | 840 | 190 | — | — | — | 0.33 | 2.1 | 150 | — | — | 55 | 100 | 820 | 60 | 50 | 100 | B | Example of invention |
| 43 | J | 820 | 840 | 180 | — | — | — | 0.33 | 2.1 | 150 | — | — | 55 | 10 | 840 | 60 | 50 | 19 | B | Comparative example |
| 44 | J | 820 | 840 | 180 | — | — | — | 0.33 | 2.1 | 150 | — | — | 55 | 50 | 840 | 60 | 50 | 55 | B | Example of invention |
| 45 | J | 820 | 840 | 180 | — | — | — | 0.33 | 2.1 | 150 | — | — | 55 | 100 | 840 | 60 | 50 | 85 | B | Example of invention |
| 46 | K | 900 | 980 | 250 | — | — | — | 0.28 | 4.5 | 500 | — | — | 50 | 30 | 865 | 95 | 40 | 95 | A | Comparative example |
| 47 | K | 900 | 980 | 250 | — | — | — | 0.28 | 4.5 | 500 | — | — | 50 | 100 | 865 | 95 | 40 | 100 | A | Comparative example |
| 48 | L | 850 | 885 | 200 | — | — | — | 0.31 | 2.1 | 150 | — | — | 50 | 10 | 850 | 60 | 50 | 0 | B | Comparative example |
| 49 | L | 850 | 885 | 200 | — | — | — | 0.31 | 2.1 | 150 | — | — | 50 | 100 | 850 | 60 | 50 | 66 | B | Comparative example |
| 50 | M | 810 | 1080 | 160 | — | — | — | 0.25 | 3.8 | 100 | — | — | 55 | 2 | 800 | 95 | 40 | 8 | B | Comparative example |
| 51 | M | 810 | 1080 | 160 | — | — | — | 0.25 | 3.8 | 100 | — | — | 55 | 100 | 800 | 95 | 40 | 92 | B | Example of invention |
| 52 | M | 810 | 1080 | 160 | — | — | — | 0.25 | 3.7 | 100 | 600 | 7 | 55 | 2 | 800 | 95 | 40 | 11 | B | Comparative example |
| 53 | M | 810 | 1080 | 160 | — | — | — | 0.25 | 3.7 | 100 | 600 | 7 | 55 | 100 | 800 | 95 | 40 | 94 | B | Example of invention |
| 54 | M | 810 | 1080 | 160 | — | — | — | 0.25 | 3.7 | 100 | 600 | 7 | 55 | 200 | 800 | 95 | 40 | 98 | B | Example of invention |

*Holding temperature in a range from temperature of completion of hot rolling (FT) to (FT-100° C.)

An underline means that the relevant steel type or value falls outside the scope of the invention.

The microstructure and mechanical properties of each of the cold-rolled steel sheets manufactured as described above were investigated as follows. The results of the investigation are collectively indicated in Table 3.

An average grain diameter of ferrite and a grain diameter of retained austenite having an aspect ratio of less than 5 in each cold-rolled steel sheet were obtained using an SEM-EBSD equipment, by referring to a structure of a cross-section in a rolling direction at a depth of ¼ the sheet thickness of the steel sheet, as in the case of the hot-rolled steel sheets. For an EBSD analysis of a structure containing the retained austenite phase, the retained austenite is concernedly not correctly measured because of disturbance at the time of sample preparation (e.g., transformation of retained austenite to martensite). Thus, in the present example, the evaluation premise that an area fraction of retained austenite obtained by an EBSD analysis (γEBSD) satisfies (γEBSD/γXRD)>0.7 relative to a volume fraction of retained austenite obtained by X-ray diffractometry (γXRD) was provided for an analysis accuracy index.

Area fractions of ferrite and the low temperature transformation phase were obtained by a structure analysis using SEM-EBSD. Also, a volume ratio of the austenite phase was obtained by means of X-ray diffractometry using the later-described equipment to use the volume ratio as an area fraction of retained austenite (retainedγ).

Measurement of a texture of each cold-rolled steel sheet was carried out by X-ray diffraction on a plane at a depth of ½ of the sheet thickness of a steel sheet. Intensities in the {100}<011> to {211}<011> orientation group were obtained using ODF (orientation distribution function) obtained by analyzing the measured results of pole figures of {200}, {110} and {211} of ferrite. From the analysis results, an ratio in intensity of each of {100}<011>, {411}<011> and {211}<011> orientations relative to a random structure not having a texture was obtained, and an average value of the ratios of the intensity was used as an average ratio of the intensity in the {100}<011> to {211}<011> orientation group. X-ray intensities of the random structure not having a texture were obtained by X-ray diffraction of powdered steel. The apparatus used for X-ray diffraction was RINT-2500HL/PC manufactured by Rigaku Corporation.

The mechanical properties of each cold-rolled steel sheet after annealing were investigated by a tensile test and a hole expanding test. The tensile test was carried out using a JIS No. 5 tensile test piece to determine a tensile strength (TS) and elongation at rupture (total elongation, El). The hole expanding test was carried out in conformity of JIS Z 2256:2010 to determine a percent hole expansion λ (%). A value of TS×El was calculated as an index for balance between the strength and the ductility, and a value of TS×λ was calculated as an index for balance between the strength and the stretch flangeability. The respective values are indicated in Table 3.

TABLE 3

| | | Structure of cold-rolled steel sheet | | | | | | | Mechanical properties of cold-rolled steel sheet | | | | | |
|---|---|---|---|---|---|---|---|---|---|---|---|---|---|---|
| | | Area Fraction (%) | | | | Grain diameter (μm) | | | | | | | | |
| Steel sheet No. | Steel type | Low-temperature transformation phase | Ferrite | Retained γ | Spherical retained γ ratio[1] (%) | Ferrite | Spherical retained γ[1] | Texture[2] | Tensile strength (Mpa) | Elongation at rupture (%) | Hole expansion percent (λ) (%) | TS × EL (MPa × %) | TS × λ (MPa × %) | Remarks |
| 1 | A | 83 | 3 | 14 | 70 | 2.8 | 1.0 | 3.3 | 1025.5 | 22.6 | 47.3 | 23176 | 48468 | Example of invention |
| 2 | A | 83 | 4 | 13 | 72 | 2.3 | 0.9 | 3.5 | 1021.2 | 23.4 | 46.1 | 23896 | 47077 | Example of invention |
| 3 | A | 86 | 3 | 11 | 72 | 2.5 | 0.9 | 3.9 | 1090.8 | 19.5 | 56.0 | 21271 | 61044 | Example of invention |
| 4 | A | 83 | 4 | 13 | 42 | 8.2 | 1.6 | 2.5 | 1025.6 | 18.7 | 47.2 | 19178 | 48406 | Comparative example |
| 5 | A | 83 | 3 | 14 | 49 | 4.8 | 1.1 | 3.2 | 1018.2 | 18.3 | 54.8 | 18633 | 55818 | Comparative example |
| 6 | A | 84 | 3 | 13 | 69 | 2.9 | 1.0 | 3.3 | 1012.2 | 21.1 | 50.4 | 21357 | 51015 | Example of invention |
| 7 | A | 84 | 3 | 13 | 70 | 2.5 | 0.9 | 3.6 | 998.2 | 22.4 | 53.0 | 22360 | 52905 | Example of invention |
| 8 | A | 83 | 3 | 14 | 45 | 7.8 | 1.4 | 2.8 | 1041.7 | 18.7 | 49.7 | 19480 | 51720 | Comparative invention |
| 11 | B | 77 | 11 | 12 | 51 | 5.3 | 1.1 | 3.0 | 987.2 | 19.8 | 45.5 | 19547 | 44918 | Comparative example |
| 12 | B | 78 | 11 | 11 | 69 | 3.2 | 1.0 | 3.4 | 976.3 | 22.9 | 58.2 | 22357 | 56821 | Example of invention |
| 13 | B | 77 | 12 | 11 | 71 | 2.9 | 0.9 | 3.4 | 915.2 | 27.8 | 42.4 | 25443 | 38804 | Example of invention |
| 14 | B | 79 | 10 | 11 | 43 | 9.2 | 1.6 | 2.3 | 974.0 | 18.2 | 49.3 | 17727 | 48018 | Comparative invention |
| 16 | B | 80 | 10 | 10 | 51 | 5.4 | 1.2 | 3.1 | 1013.0 | 18.2 | 56.3 | 18437 | 57007 | Comparative example |
| 17 | B | 80 | 11 | 9 | 73 | 3.1 | 0.9 | 3.3 | 1019.7 | 20.2 | 66.6 | 20598 | 67887 | Example of invention |
| 18 | B | 80 | 11 | 9 | 61 | 3.1 | 0.9 | 3.5 | 944.0 | 22.7 | 55.9 | 21429 | 52758 | Example of invention |
| 19 | C | 86 | 3 | 11 | 52 | 4.2 | 1.0 | 3.1 | 1110.5 | 15.4 | 48.8 | 17102 | 54151 | Comparative example |

TABLE 3-continued

| | | Structure of cold-rolled steel sheet | | | | | | | Mechanical properties of cold-rolled steel sheet | | | | | |
|---|---|---|---|---|---|---|---|---|---|---|---|---|---|---|
| | | Area Fraction (%) | | | | Grain diameter (μm) | | | | | | | | |
| Steel sheet No. | Steel type | Low-temperature transformation phase | Ferrite | Retained γ | Spherical retained γ ratio[1] (%) | Ferrite | Spherical retained γ[1] | Texture[2] | Tensile strength (Mpa) | Elongation at rupture (%) | Hole expansion percent (λ) (%) | TS × EL (MPa × %) | TS × λ (MPa × %) | Remarks |
| 20 | C | 85 | 4 | 11 | 71 | 2.8 | 0.9 | 3.6 | 1023.5 | 20.4 | 48.4 | 20879 | 49499 | Example of invention |
| 21 | C | 86 | 4 | 10 | 71 | 2.6 | 0.9 | 3.7 | 1022.2 | 21.1 | 49.0 | 21567 | 50060 | Example of invention |
| 22 | D | 83 | 3 | 14 | 51 | 4.4 | 1.1 | 3.2 | 976.0 | 19.9 | 47.7 | 19422 | 46543 | Comparative example |
| 23 | D | 84 | 4 | 12 | 69 | 3.2 | 0.9 | 3.3 | 982.5 | 21.9 | 46.4 | 21516 | 45537 | Example of invention |
| 24 | D | 84 | 4 | 12 | 72 | 3.0 | 0.9 | 4.1 | 1016.8 | 20.9 | 48.6 | 21250 | 49427 | Example of invention |
| 25 | E | 83 | 2 | 15 | 53 | 4.4 | 1.0 | 3.2 | 1108.2 | 17.1 | 51.3 | 18950 | 56851 | Comparative example |
| 26 | E | 83 | 3 | 14 | 72 | 2.7 | 0.9 | 3.4 | 1096.3 | 20.8 | 49.4 | 22803 | 54157 | Example of invention |
| 27 | E | 75 | 15 | 10 | 79 | 2.1 | 0.9 | 8.2 | 1132.7 | 17.5 | 31.2 | 19822 | 35340 | Comparative example |
| 28 | F | 86 | 3 | 11 | 53 | 4.1 | 1.1 | 3.2 | 1082.1 | 15.4 | 58.3 | 16664 | 63032 | Comparative example |
| 29 | F | 78 | 12 | 10 | 72 | 2.1 | 0.9 | 3.5 | 1016.1 | 21.4 | 53.4 | 21743 | 54244 | Example of invention |
| 30 | F | 87 | 2 | 11 | 47 | 6.2 | 1.2 | 2.8 | 972.3 | 16.7 | 54.2 | 16237 | 52699 | Comparative example |
| 31 | F | 71 | 19 | 10 | 75 | 2.0 | 0.9 | 4.3 | 988.7 | 23.8 | 49.9 | 23531 | 49348 | Example of invention |
| 32 | F | 55 | 36 | 9 | 75 | 3.2 | 1.0 | 3.3 | 967.3 | 23.6 | 47.8 | 22828 | 46237 | Example of invention |
| 33 | F | 63 | 27 | 10 | 55 | 4.6 | 1.1 | 3.1 | 1021.0 | 16.2 | 54.3 | 16540 | 55440 | Comparative example |
| 34 | F | 57 | 34 | 9 | 79 | 2.8 | 0.9 | 3.6 | 981.0 | 22.4 | 56.2 | 21974 | 55132 | Example of invention |
| 35 | G | 87 | 2 | 11 | 62 | 4.5 | 1.1 | 2.9 | 898.3 | 22.9 | 44.8 | 20571 | 40199 | Comparative example |
| 36 | G | 88 | 2 | 10 | 73 | 2.8 | 0.9 | 3.3 | 879.9 | 27.6 | 48.7 | 24284 | 42871 | Example of invention |
| 37 | H | 65 | 22 | 13 | 56 | 5.3 | 1.4 | 2.7 | 1123.1 | 16.2 | 49.2 | 18194 | 55257 | Comparative example |
| 38 | H | 59 | 29 | 12 | 71 | 2.8 | 0.9 | 3.2 | 1083.6 | 19.2 | 53.8 | 20805 | 58298 | Example of invention |
| 39 | H | 55 | 34 | 11 | 78 | 2.3 | 0.9 | 3.4 | 1096.4 | 20.3 | 52.9 | 22257 | 58000 | Example of invention |
| 40 | H | 56 | 33 | 11 | 78 | 2.4 | 0.9 | 3.3 | 1073.9 | 19.8 | 54.2 | 21263 | 58205 | Example of invention |
| 41 | I | 89 | 2 | 9 | 39 | 4.8 | 1.3 | 2.7 | 845.5 | 20.1 | 58.2 | 16995 | 49208 | Comparative example |
| 42 | I | 89 | 2 | 9 | 63 | 2.3 | 0.9 | 3.7 | 832.1 | 25.2 | 57.3 | 20969 | 47679 | Example of invention |
| 43 | J | 88 | 5 | 7 | 58 | 5.6 | 1.3 | 2.9 | 888.0 | 15.4 | 65.2 | 13675 | 57898 | Comparative example |
| 44 | J | 88 | 5 | 7 | 72 | 3.2 | 1.0 | 3.3 | 871.5 | 22.8 | 63.1 | 19870 | 54992 | Example of invention |
| 45 | J | 87 | 6 | 7 | 75 | 2.7 | 0.9 | 3.3 | 862.1 | 22.9 | 62.6 | 19742 | 53967 | Example of invention |
| 46 | K | 90 | 2 | 8 | 72 | 2.7 | 0.9 | 5.1 | 1069.0 | 17.2 | 44.2 | 18387 | 47250 | Comparative example |
| 47 | K | 90 | 2 | 8 | 75 | 2.1 | 0.9 | 5.2 | 1073.0 | 16.3 | 47.6 | 17490 | 51075 | Comparative example |
| 48 | L | 13 | 87 | 0 | — | 6.4 | — | 2.1 | 481.2 | 29.9 | 108.0 | 14388 | 51970 | Comparative example |
| 49 | L | 11 | 89 | 0 | — | 6.1 | — | 2.2 | 489.3 | 30.1 | 109.0 | 14728 | 53334 | Comparative example |
| 50 | M | 92 | 5 | 2 | — | 4.5 | — | 2.8 | 911.5 | 11.915 | 62.22 | 10860 | 56714 | Comparative example |
| 51 | M | 91 | 7 | 1 | — | 2.4 | — | 3.3 | 901.5 | 15.926 | 71.21 | 14357 | 64196 | Example of invention |
| 52 | M | 94 | 3 | 2 | — | 4.2 | — | 3.1 | 902 | 14.897 | 47.41 | 13437 | 42762 | Comparative example |
| 53 | M | 92 | 5 | 2 | — | 2.3 | — | 3.6 | 909 | 14.56 | 71.99 | 13235 | 65438 | Example of invention |

TABLE 3-continued

| | | Structure of cold-rolled steel sheet | | | | | | | Mechanical properties of cold-rolled steel sheet | | | | | |
|---|---|---|---|---|---|---|---|---|---|---|---|---|---|---|
| | | Area Fraction (%) | | | | Grain diameter (μm) | | | | | | | | |
| Steel sheet No. | Steel type | Low-temperature transformation phase | Ferrite | Retained γ | Spherical retained γ ratio[1] (%) | Ferrite | Spherical retained γ[1] | Texture[2] | Tensile strength (Mpa) | Elongation at rupture (%) | Hole expansion percent (λ) (%) | TS × EL (MPa × %) | TS × λ (MPa × %) | Remarks |
| 54 | M | 90 | 8 | 1 | — | 2.1 | — | 5.2 | 913 | 15.8 | 75.5 | 14425 | 68931 | Example of invention |

[1] Lump-like retained γ = lump-like retained austenite having an aspect ratio of less than 5

[2] Texture = avarage X-ray intensity of a {100}<011> to {211}<011> orientations An underline means that the relevant steel type or value falls outside the scope of the present invention.

Of steel sheet Nos. 1 to 8 manufactured from steel type A, in steel sheets Nos. 1 to 3 and 6, and 7 in which heating rates during annealing are at least 15° C./sec, a cold-rolled steel sheet having a microstructure according to the present invention was each obtained. In particular, in steel sheets Nos. 1 to 3, 6 and 7 which use a fine grain hot-rolled steel sheet satisfying the conditions for cooling after hot rolling in Equation (4) as a base material, finer retained austenite grains were obtained.

On the other hand, in steel sheet No. 4, the soaking temperature during annealing was high, and in steel sheets Nos. 5 and 8, the heating rate during annealing was low, resulting in the proportion of retained lump-like γ having an aspect ratio of less than 5 relative to retained austenite (retained γ) becoming less than 50%, and thus, above Equation (2) was not satisfied and the grain diameters of ferrite, which is a second phase, were coarse.

Results similar to the above were obtained for the other steel types, and high workability was obtained in each of the examples of the invention.

On the other hand, in steel sheets Nos. 5, 8, 11, 14, 16, 19, 22, 25, 28, 33, 35, 37, 41, 43, 48, 50 and 52, the heating rate during annealing was less than 15° C./sec, and thus, the proportion of the unrecrystallization at $Ac_1$+10° C. was less than 30%. Thus, the microstructure of the cold-rolled steel sheet coarsened and the average grain diameter of ferrite exceeds the upper limit specified in the present invention. As a result, the mechanical properties were insufficient.

In steel sheets Nos. 4 and 30, rapid heating was carried out during annealing, but since the annealing temperature exceeded $Ac_3$+100° C., the microstructure of the cold-rolled steel sheet coarsened and the grain diameter of ferrite exceeded the upper limit specified in the present invention. As a result, good mechanical properties were not obtained.

Since for steel sheet No. 27, the annealing temperature was lower than ($0.3\times Ac_1+0.7\times Ac_3$), and as a result, the texture did not satisfy the requirement of the present invention. Accordingly, good mechanical properties could not be obtained.

For steel sheets No. 46 and 47, which have an Nb content of 0.123%, the steel was excessively hardened and thereby the workability deteriorated. As a result, the mechanical properties of the cold-rolled steel sheet were low irrespective of the heating rate.

Furthermore, in steel sheets Nos. 48 and 49, which have an Si content of 0.06%, no retained austenite was produced in the cold-rolled steel sheet. Thus, the ductility remained low regardless of the low strength. As a result, the mechanical properties of the cold-rolled steel sheet were low irrespective of the heating rate.

The invention claimed is:

1. A cold-rolled steel sheet characterized by having:

a chemical composition comprising, in mass % of C: 0.06 to 0.3, Si: 0.6 to 2.5%, Mn: 0.6 to 3.5%, P: at most 0.1%, S: at most 0.05%, Ti: 0 to 0.08%, Nb: 0 to 0.04%, total of Ti and Nb: 0 to 0.10%, sol.Al: 0 to 2.0%, Cr: 0 to 1%, Mo: 0 to 0.3%, V: 0 to 0.3%, B: 0 to 0.005%, Ca: 0 to 0.003%, REM: 0 to 0.003% and the remainder of Fe and impurities;

a microstructure having a main phase of either or both of martensite and bainite which comprises at least 40 area % in total; and a texture in which proportion of an average X-ray intensity for {100}<011> to {211}<011> orientations relative to the average X-ray intensity of a random structure which does not have a texture at a depth of ½of a sheet thickness is less than 6, wherein the microstructure has secondary phases including ferrite and retained austenite, the ferrite comprises 3 to 19 area % and satisfies Equation (1) and the retained austenite comprises at least 3 area % and satisfies Equations (2) and (3):

$$d_F \leq 4.0 \quad (1);$$

$$d_{As} \leq 1.5 \quad (2); \text{ and}$$

$$r_{As} \geq 50 \quad (3),$$

where $d_F$ is an average grain diameter in μm of ferrite defined by high angle grain boundaries having a tilt angle of at least 15°, $d_{As}$ is an average grain diameter in μm of retained austenite having an aspect ratio of less than 5 and $r_{As}$ is an area fraction in % of the retained austenite having an aspect ratio of less than 5 relative to all retained austenite.

2. The cold-rolled steel sheet as forth in claim 1, wherein the main phase comprises 71 area % or more.

3. The cold-rolled steel sheet as set forth in claim 1, wherein the chemical composition comprises one or two elements selected from, in mass % Ti: 0.005 to 0.08% and Nb: 0.003 to 0.04%.

4. The cold-rolled steel sheet as forth in claim 3, wherein the main phase comprises 71 area % or more.

5. The cold-rolled steel sheet as set forth in claim 1, wherein the chemical composition comprises, in mass %, sol.Al: 0.1 to 2.0%.

6. The cold-rolled steel sheet as forth in claim 5, wherein the main phase comprises 71 area % or more.

7. The cold-rolled steel sheet as set forth in claim 1, wherein the chemical composition comprises one or more elements selected from, in mass % Cr: 0.03 to 1%, Mo: 0.01 to 0.3% and V: 0.01 to 0.3%.

8. The cold-rolled steel sheet as forth in claim 7, wherein the main phase comprises 71 area % or more.

9. The cold-rolled steel sheet as set forth in claim 1, wherein the chemical composition comprises, in mass %, B: 0.0003 to 0.005%.

10. The cold-rolled steel sheet as forth in claim 9, wherein the main phase comprises 71 area % or more.

11. The cold-rolled steel sheet as set forth in claim 1, wherein the chemical composition comprises one or two elements selected from, in mass %, Ca: 0.0005 to 0.003% and REM: 0.0005 to 0.003%.

12. The cold-rolled steel sheet as forth in claim 11, wherein the main phase comprises 71 area % or more.

13. The cold-rolled steel sheet as set forth in claim 1, comprising a plating layer on a surface of the cold-rolled steel sheet.

14. The cold-rolled steel sheet as forth in claim 13, wherein the main phase comprises 71 area % or more.

15. Process for manufacturing a cold-rolled steel sheet according to claim 1, the process comprising the following steps (A) and (B):

(A) a cold rolling step in which a hot-rolled steel sheet having a chemical composition comprising, in mass % of C: 0.06 to 0.3, Si: 0.6 to 2.5%, Mn: 0.6 to 3.5%, P: at most 0.1%, S: at most 0.05%, Ti: 0 to 0.08%, Nb: 0 to 0.04%, total of Ti and Nb: 0 to 0.10%, sol.Al: 0 to 2.0%, Cr: 0 to 1%, Mo: 0 to 0.3%, V: 0 to 0.3%, B: 0 to 0.005%, Ca: 0 to 0.003%, REM: 0 to 0.003% and the remainder of Fe and impurities is cold rolled to obtain a cold-rolled steel sheet; and (B) an annealing step in which the cold-rolled steel sheet obtained in the step (A) is heated under conditions that the cold-rolled steel sheet is heated at an average heating rate condition of at least 15° C./sec so that an proportion of an unrecrystallization of a region not transformed to austenite at a time of reaching ($Ac_1$ point +10° C.) becomes at least 30 area %, and is then held in a temperature range of at least ($0.3\times Ac_1$ point+ $0.7\times Ac_3$ point) and at most ($Ac_3$ point+100° C.) for at least 30 seconds, and the steel sheet is then cooled at an average cooling rate of at least 10° C./sec for a temperature range of at most 650° C. and at least 500° C.

16. The process for manufacturing a cold-rolled steel sheet as set forth in claim 15, wherein after completion of hot rolling, the hot-rolled steel sheet is coiled at a temperature of at most 300° C. and then subjected to heat treatment in a temperature range of 500° C. to 700° C.

17. The process for manufacturing a cold-rolled steel sheet production as set forth in claim 15, further comprising the step of plating the cold-rolled steel sheet after the step (B).

18. The process for manufacturing a cold-rolled steel sheet as set forth in claim 15, wherein the hot-rolled steel sheet is a steel sheet in which average grain diameter of a BCC phase defined by high angle grain boundaries having a tilt angle of at least 15° is at most 6 μm, the steel sheet being obtained by a hot rolling step of cooling at a cooling rate (Crate) satisfying following Equation (4) for a temperature range from a temperature at the completion of rolling to (temperature at the completion of rolling −100° C.) after completion of hot rolling in which hot rolling is completed at at least $Ar_3$ point:

$$IC(T) = 0.1 - 3\times10^{-3}\cdot T + 4\times10^{-5}\cdot T^2 - 5\times10^{-7}\cdot T^3 + 5\times10^{-9}\cdot T^4 - 7\times10^{-11}\cdot T^5 \int_0^{-100} \frac{-dT}{\mathrm{Crate}(T)\cdot IC(T)} < 4 \quad (4)$$

where Crate (T) is a cooling rate (° C./s) (positive value), T is a relative temperature (° C., negative value) with the temperature at the completion of rolling as zero, and if there is a temperature at which Crate is zero, a value obtained by dividing a holding time (Δt) at the temperature by IC (T) is added as an integral for the section.

19. The process for manufacturing a cold-rolled steel sheet as set forth in claim 18, wherein the cooling in the temperature range includes starting cooling at a cooling rate of at least 400° C./sec and cooling at the cooling rate in a temperature range of at least 30° C.

20. The process for manufacturing a cold-rolled steel sheet production as set forth in claim 18, wherein the cooling in the temperature range includes starting water cooling at a cooling rate of at least 400° C./sec and cooling at the cooling rate for a temperature section of at least 30° C. and at most 80° C., and then stopping a water cooling stop time of 0.2 to 1.5 seconds to measure a shape of the sheet during the time, and subsequently cooling at a rate of at least 50° C./sec.

* * * * *